US007468701B2

(12) United States Patent
Fujikawa et al.

(10) Patent No.: US 7,468,701 B2
(45) Date of Patent: Dec. 23, 2008

(54) ATTACHMENT/DETACHMENT MECHANISM FOR COMPACT ANTENNA

(75) Inventors: Hiroshi Fujikawa, Tokyo (JP); Keiichi Ogura, Tokyo (JP)

(73) Assignee: SMK Corporation, Tokyo (JP)

( * ) Notice: Subject to any disclaimer, the term of this patent is extended or adjusted under 35 U.S.C. 154(b) by 165 days.

(21) Appl. No.: 11/551,779

(22) Filed: Oct. 23, 2006

(65) Prior Publication Data

US 2007/0205960 A1 Sep. 6, 2007

(30) Foreign Application Priority Data

Mar. 3, 2006 (JP) ..... 2006-058219

(51) Int. Cl.
*H01Q 1/24* (2006.01)

(52) U.S. Cl. ..... 343/702; 343/715; 343/903; 343/906

(58) Field of Classification Search ..... 343/702, 343/715, 888, 900, 903, 906, 700 MS
See application file for complete search history.

(56) References Cited

U.S. PATENT DOCUMENTS 5,973,645 A * 10/1999 Zigler et al. ..... 343/702
6,283,790 B1 * 9/2001 Idehara et al. ..... 439/582
6,518,928 B1 * 2/2003 Sheu ..... 343/702
6,707,430 B2 * 3/2004 Sakaguchi et al. ..... 343/702
7,046,212 B2 * 5/2006 Tai et al. ..... 343/882
7,193,570 B2 * 3/2007 Liu ..... 343/702
2006/0273980 A1 * 12/2006 Chan ..... 343/906

FOREIGN PATENT DOCUMENTS

JP 2003-032016 A 1/2003

OTHER PUBLICATIONS

Patent Abstracts of Japan for JP2003-032016 published on Jan. 31, 2003.

* cited by examiner

*Primary Examiner*—Douglas W. Owens
*Assistant Examiner*—Chuc Tran
(74) *Attorney, Agent, or Firm*—Darby & Darby P.C.

(57) ABSTRACT

An attachment/detachment mechanism for an antenna is configured to avoid damage to the antenna when an excessively large force is applied to the antenna, regardless of the direction. A rotational L-shaped connector of an antenna section of the antenna is connected to an antenna housing disposed on a main electronic device unit. A fitting groove is formed on a male fitting cylinder on the rotational L-shaped connector side, and an O-ring is fitted to the groove. An engagement projection formed on an inner wall of a female fitting cylinder on the antenna housing frictionally engages with the O-ring. This configuration allows rotation and attachment/detachment of the antenna section relative to the antenna housing. A contact member is attached to the fitting cylinder to contact a contact spring 31 that presses the O-ring against the engagement projection.

5 Claims, 5 Drawing Sheets

ATTACHMENT/DETACHMENT MECHANISM FOR COMPACT ANTENNA

CROSS-REFERENCE TO RELATED APPLICATION

The present application claims priority under 35 U.S.C. §119 to Japanese Patent Application No. 2006-058219, filed on Mar. 3, 2006. The content of Japanese Patent Application No. 2006-058219 is incorporated herein by reference in its entirety.

FIELD OF THE INVENTION

The present invention relates to an attachment/detachment mechanism for a compact antenna that is attached to an electronic device (for example, a personal computer or a telephone). More specifically, the present invention relates to an attachment/detachment mechanism for a compact antenna that avoids damage when an abnormally large force is applied to the antenna.

BACKGROUND OF THE INVENTION

Referring to FIG. 7, there is shown an example of a conventional technology used for removable insertion of a modem card 11 to a notebook computer 10, as is described in Japanese Laid-Open Patent Publication Number 2003-32016, published Jan. 31, 2003. An antenna 12 for wireless communication is attached to the modem card 11 and is raised upright during use and turned down when not in use.

More specifically, the antenna 12 is connected in a crank arrangement with a first L-shaped rotation connector 13 and a second L-shaped rotation connector 14, and a plug 18 of the second L-shaped rotation connector 14 is inserted and connected to a socket 19 of the modem card 11. With the first L-shaped rotation connector 13 and the second L-shaped rotation connector 14, an engagement ridge 16 formed on the first L-shaped rotation connector 13 rotatably engages with an engagement groove 15 on the second L-shaped rotation connector 14. Also, a signal line 17 is inserted through the center of the first L-shaped rotation connector 13 and the second L-shaped rotation connector 14.

With this structure, the antenna 12 is able to rotate around an axis X of the plug 18 while also being able to rotate around an engagement axis Y of the first L-shaped rotation connector 13 and the second L-shaped rotation connector 14. This makes it possible to adjust the orientation of the antenna 12 and also allows the antenna 12 to be folded down toward the modem card 11.

Since this antenna 12 projects from the notebook computer 10 and the modem card 11, it becomes an obstruction during use or transporting of the notebook computer 10, and as a result, may be subjected to large forces at times.

As a result, even if the plug 18 is made removable in the axial direction or a flexible material is used for the antenna 12, the application of a large force in a direction other than the axis of the antenna 12 can lead to destruction of the antenna 12 or other components of the device.

SUMMARY OF THE INVENTION

The present invention provides an attachment/detachment mechanism for a compact antenna in which an antenna housing is provided on a main electronic device unit and an antenna is connected to the antenna housing. A rotatable and removable connection between the antenna housing and the L-shaped rotation connector is provided by forming a fitting groove on an outer perimeter of a male fitting cylinder on the L-shaped rotation connector side, fitting an elastic O-ring in the fitting groove, and forming an engagement projection on an inner wall of a female fitting cylinder on the antenna housing side to push against and engage with the O-ring.

A contact member with an exposed tip is attached to a fitting hole of the fitting cylinder; and a contact spring facing the contact member connects with a contact section inside the antenna housing to push the O-ring toward the engagement projection. As a result, the invention can provide both position adjustment of the antenna through rotation as well as an attachment/detachment mechanism for the antenna.

Also, the biasing from the contact spring pushes the O-ring toward the engagement projection by way of the fitting cylinder to form a tight fit. The resistance from this tight fit restricts motion of the antenna caused by its own weight and by small forces, thus providing a stable connection. In addition, when an external force of sufficient predetermined value (e.g., 2 kG or more) is applied to the antenna, the antenna disengages from the main electronic device unit, preventing damage to the antenna and to the main electronic device unit.

In a second embodiment of the invention, the rotatable and removable connection between the antenna housing and the L-shaped rotation connector is provided by forming a fitting groove on an outer perimeter of a male fitting cylinder on the antenna housing side, fitting an elastic O-ring into the fitting groove, and forming an engagement projection on an inner wall of a female fitting cylinder on the L-shaped rotation connector side to push against and engage with the O-ring.

In a third embodiment of the invention, the rotatable and removable connection between the antenna housing and the L-shaped rotation connector is provided by forming a fitting groove on an outer perimeter of a male fitting cylinder on the L-shaped rotation connector side, fitting a plurality of balls biased outward by a spring in the fitting groove, and forming an engagement projection on an inner wall of a female fitting cylinder on the L-shaped rotation connector side to press against and engage with the balls.

In a fourth embodiment of the invention, the rotatable and removable connection between the antenna housing and the L-shaped rotation connector is provided by forming a fitting groove on an outer perimeter of the male fitting cylinder on the antenna housing side, fitting a plurality of balls biased outward by a spring in the fitting groove, and forming an engagement projection on an inner wall of a female fitting cylinder on the L-shaped rotation connector side to press against and engage with the balls.

BRIEF DESCRIPTION OF THE DRAWINGS

The invention will become more readily apparent from the Detailed Description of the Invention, which proceeds with reference to the drawings, in which:

FIG. 1(*b*) is a side-view drawing of an antenna element 47 in an antenna 12;

DETAILED DESCRIPTION OF THE INVENTION

Figure 1A:
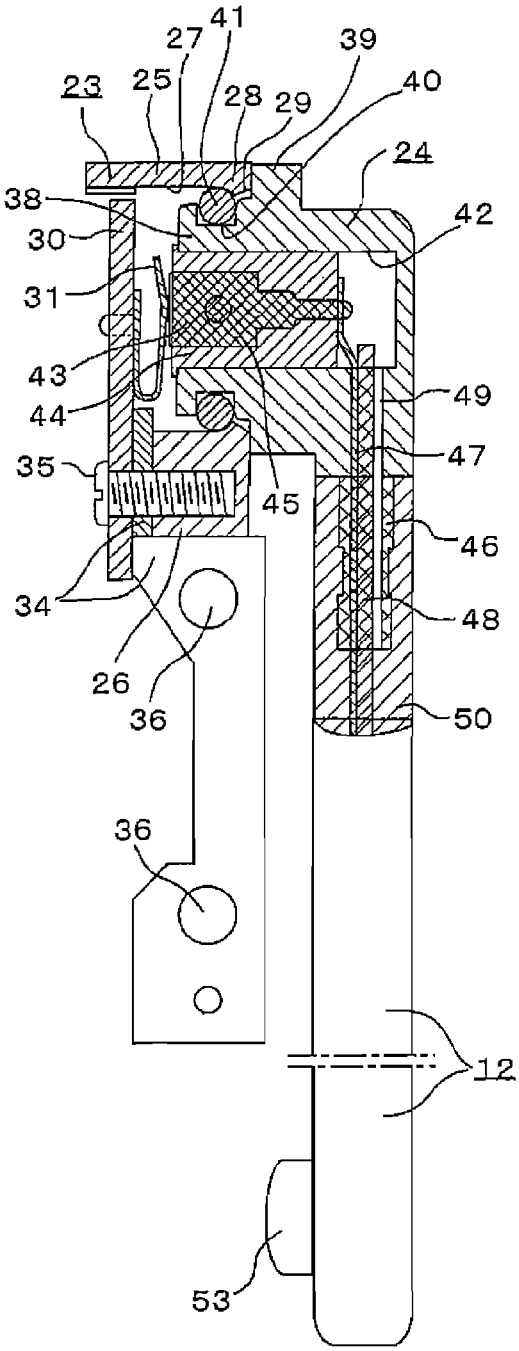
FIG. 1(*a*) is a partially cut-away front-view drawing of a first embodiment of an attachment/detachment mechanism for a compact antenna according to the present invention.

In the present invention as illustrated in FIGS. 1-6, a compact antenna is formed with an antenna housing 23 provided for a main electronic device unit 20, and an antenna 12 is connected to the antenna housing 23. An L-shaped rotation connector 24 provided on the antenna 12 is rotatably and removably connected to the antenna housing 23 to make the compact antenna removable.

The rotatable and removable connection between the antenna housing 23 and the L-shaped rotation connector 24 is provided by forming a fitting groove 40 on the outer perimeter of a male fitting cylinder 38 on the L-shaped rotation connector 24. An elastic O-ring 41 is fitted to the fitting groove 40. An engagement projection 28 that pushes into and engages with the O-ring 41 is formed on the inner wall of a female fitting cylinder 25 on the antenna housing 23.

Also, a contact member 43 with an exposed tip is attached to a fitting hole 42 of the fitting cylinder 38 and comes into contact with a contact section 30 formed on the inside of the antenna housing 23 facing the contact member 43. A contact spring 31 that pushes the O-ring 41 into contact with the engagement projection 28 provides a reliable bond.

The rotatable and removable connection between the antenna housing 23 and the L-shaped rotation connector 24 is not restricted to the above example. It would also be possible to form the fitting groove 40 on the outer perimeter of a male fitting cylinder 25, with the elastic O-ring 41 fitted into the fitting groove 40. The engagement projection 28, which presses against and engages with the O-ring 41 can be formed on the inner wall of the female fitting cylinder 38 on the L-shaped rotation connector 24.

Furthermore, it would also be possible to have the rotatable and removable connection between the antenna housing 23 and the L-shaped rotation connector 24 formed by forming the fitting groove 40 on the outer perimeter of the male fitting cylinder 38 on the L-shaped rotation connector 24 and to fit multiple balls 54 biased outward by a spring 55 in the fitting groove 40. The engagement projection 28, which presses against and engages with the balls 54, can be formed on the inner wall of the female fitting cylinder 25 on the L-shaped rotation connector 24.

Furthermore, it would also be possible to have the rotatable and removable connection between the antenna housing 23 and the L-shaped rotation connector 24 formed by forming the fitting groove 40 on the outer perimeter of the male fitting cylinder 25 on the antenna housing 23. Multiple balls 54 biased outward by the spring 55 would be fitted in the fitting groove 40, and the engagement projection 28, which presses against and engages with the balls 54, would be formed on the inner wall of the female fitting cylinder 38 on the L-shaped rotation connector 24.

Figure 1B:
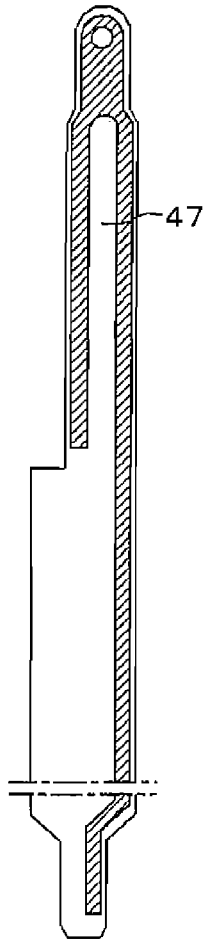
Figure 2:
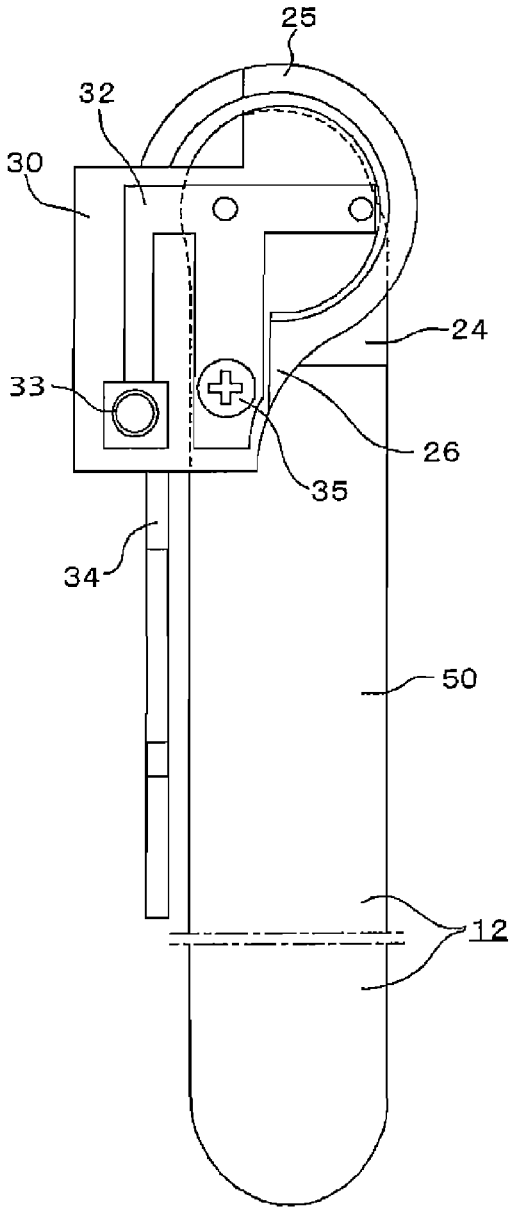
FIG. 2 is a side-view drawing of the attachment/detachment mechanism for a compact antenna shown in FIGS. 1(*a*), (*b*)
Figure 3:
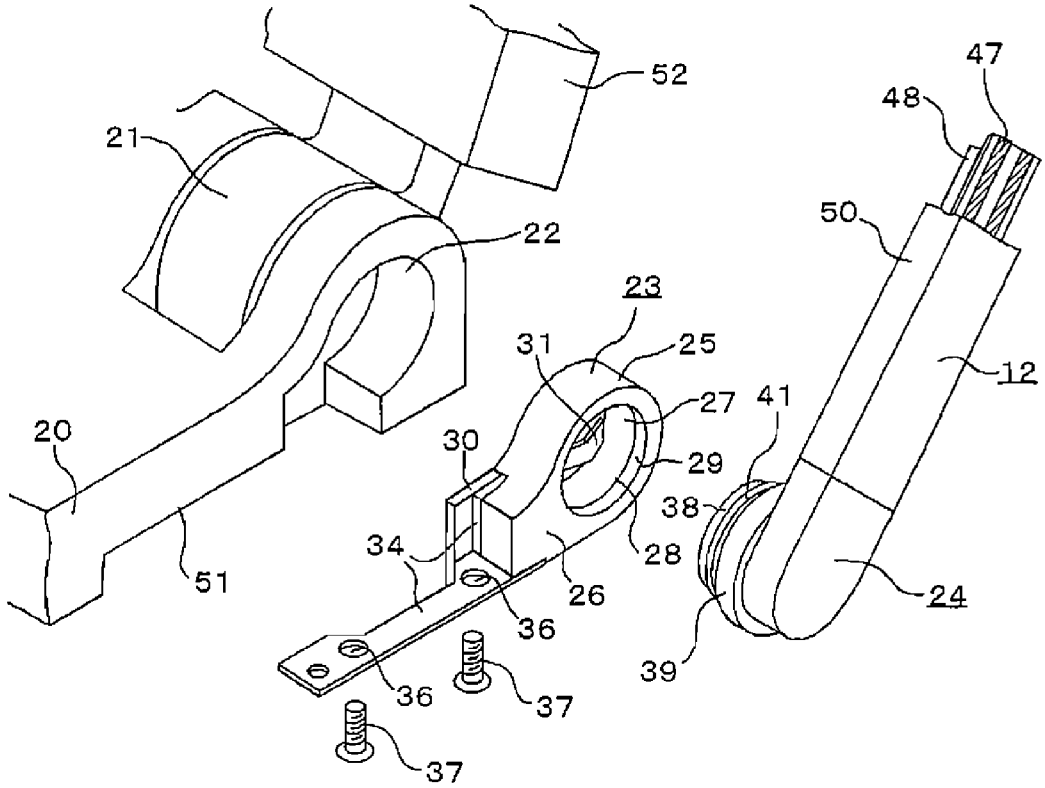
FIG. 3 is an exploded perspective drawing of the attachment/detachment mechanism for a compact antenna shown in FIG. 1.

With reference to FIG. 1 through FIG. 3, a first embodiment of an attachment/detachment mechanism for a compact antenna according to the present invention will be described.

In FIG. 3, a display 52 is attached to the main electronic device unit 20, e.g., a notebook computer, using a hinge 21 to allow opening and closing. The antenna attachment section 22 for fitting and attaching the antenna housing 23 described later is provided on the side end of the hinge 21.

The antenna housing 23 is formed from an insulator such as plastic and includes the fitting cylinder 25, with a diameter of approximately 11 mm and both ends open, and a base 26 extending in one direction from the fitting cylinder 25. At one of the openings of the fitting cylinder 25, the engagement projection 28 is formed on the inner perimeter near the opening end to allow the L-shaped rotation connector 24 described later to be removably fitted. The open end of the engagement projection 28 is formed as a tapered section 29 to act as a guide when the L-shaped rotation connector 24 is fitted. Also, the inside of the engagement projection 28 is formed as a curved surface similar to that of the O-ring 41 described later to provide a tight fit with the O-ring 41.

The contact section 30, which may for example comprise a printed substrate, is provided on the other open end of the fitting cylinder 25, and this contact section 30 is attached with a screw 35 along with a ground/attachment plate 34 to the base 26 of the antenna housing 23. At roughly the center on the inner side of the contact section 30 is attached the elastic contact spring 31 bent in a U-shape. A first end of the contact spring 31 is connected to a connector 33 by way of a printed circuit section 32 formed outward from the contact section 30. The second end is connected by the screw 35 to the ground/attachment plate 34.

The ground/attachment plate 34 is extended further toward the base 26 of the antenna housing 23, and this extended section is abutted against an attachment surface 51 of the antenna attachment section 22 and is secured with a screw 37 through an attachment screw hole 36 of the ground/attachment plate 34.

A collar 39 having roughly the same diameter as the outer perimeter of the fitting cylinder 25 is formed integrally on one side surface of the L-shaped rotation connector 24. The fitting cylinder 38 is formed integrally at the end of the collar 39 with a diameter slightly smaller than that of an inner wall surface 27 of the fitting cylinder 25. The fitting groove 40 is formed on the outer perimeter of the fitting cylinder 38, and the elastic O-ring 41, formed from rubber or the like, is fitted in the fitting groove 40. The collar 39 and the fitting cylinder 38 of the L-shaped rotation connector 24 are formed with an internal fitting hole 42. The contact member 43, with its outer perimeter covered with an insulating material 44, is fitted in the fitting hole 42 and is secured by a pin 45 to the fitting cylinder 38. A first end of the contact member 43 is exposed to the outside while a second end is projected from the insulating material 44 in the fitting hole 42.

The antenna 12, having a length of approximately 80 mm, is attached to the L-shaped rotation connector 24. In the antenna 12, an antenna element 47 is fastened to an elastic and insulative reinforcement plate 48 and is passed through an insertion hole 49 of the L-shaped rotation connector 24 and projected inside. The projected end of the antenna element 47 forms an electrical connection with the end of the contact member 43. Also, the end of the antenna element 47 passes through a guide 46 of the L-shaped rotation connector 24 and is covered with a bendable cover 50. The inside of the end of the cover 50 (the side toward the main electronic device unit 20) is formed integrally with an engagement projection 53 that engages with a side surface of a display 52 when the display 52 is closed. The operation of this structure will be described.

The fitting cylinder 25 of the antenna housing 23 is fitted in the antenna attachment section 22. The ground/attachment plate 34 is abutted against a lower surface of the attachment surface 51 and secured with the screw 37.

Also, the fitting cylinder 38 of the L-shaped rotation connector 24 is pushed in from the tapered section 29 of the antenna housing 23, pushing past the engagement projection 28 while somewhat crushing the outer perimeter of the O-ring 41. This results in the contact and engagement of the end surface of the collar 39 and the end surface of the fitting cylinder 25. In this arrangement, the end surface of the contact member 43 is pressed against the contact spring 31, forming an electrical connection. At the same time, the contact spring 31 pushes the O-ring 41 toward the engagement projection 28 by way of the fitting cylinder 38, forming a tight fit. The resistance from this tight fit restricts the antenna 12 from moving due to its own weight or from small forces, thus providing a stable connection. Also, the connector 33 is connected to a connector not shown in the figure in the main electronic device unit 20.

The display 52 is then opened and the main personal computer electronic device unit 20 is operated. The antenna 12 is adjusted by rotating the section of the O-ring 41 to provide optimal sensitivity.

When the main electronic device unit 20 is being used, if a force acts on the antenna 12 in a direction other than the rotatable direction while the main electronic device unit 20 is being transported or the like, the L-shaped rotation connector 24 side does not disengage from the antenna housing 23 if the force does not exceed a fixed standard operating value. Also, since the antenna 12 has flexibility, the L-shaped rotation connector 24 side does not disengage from the antenna housing 23 even if the antenna 12 is twisted.

If, for some reason, an excessively large force is applied to the L-shaped rotation connector 24 (for example, a force of at least 2 kG), the O-ring 41 goes past the engagement projection 28 before the antenna 12 is destroyed. If the L-shaped rotation connector 24 disengages, it is pushed into the fitting cylinder 25 again to restore the original arrangement.

When the display 52 is closed after use of the main electronic device unit 20, the engagement projection 53 of the antenna 12 provided on the side surface of the hinge 21 engages with the side surface of the display 52 so that it is folded down to the side surface of the main electronic device unit 20.

Figure 4:
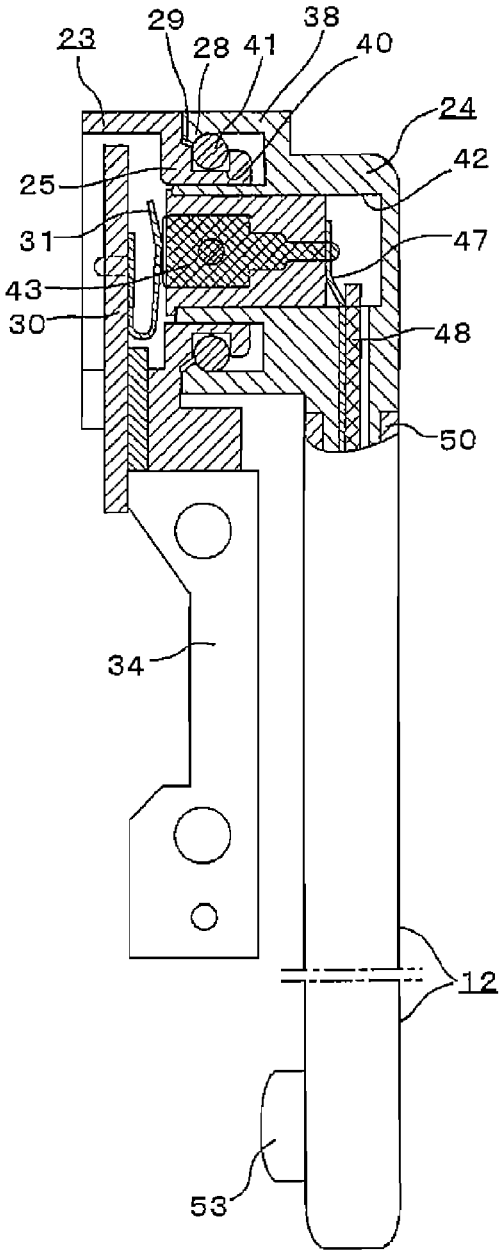
FIG. 4 is a partially cut-away front-view drawing of a second embodiment of an attachment/detachment mechanism for a compact antenna according to the present invention.

In the first embodiment described with reference to FIGS. 1-3, the O-ring 41 is provided on the L-shaped rotation connector 24 on the antenna 12 side and the engagement projection 28 is provided on the fitting cylinder 25 on the antenna housing 23 side. As shown in FIG. 4, however, it would also be possible to have the engagement projection 28 provided on the L-shaped rotation connector 24 on the antenna 12 side and the O-ring 41 provided on the fitting cylinder 25 on the antenna housing 23 side. In this case, the contact spring 31 pushes the engagement projection 28 on the fitting cylinder 38 side against the side surface of the O-ring 41, restricting the antenna 12 from moving due to its own weight or small forces, thus providing a stable connection.

Figure 5:
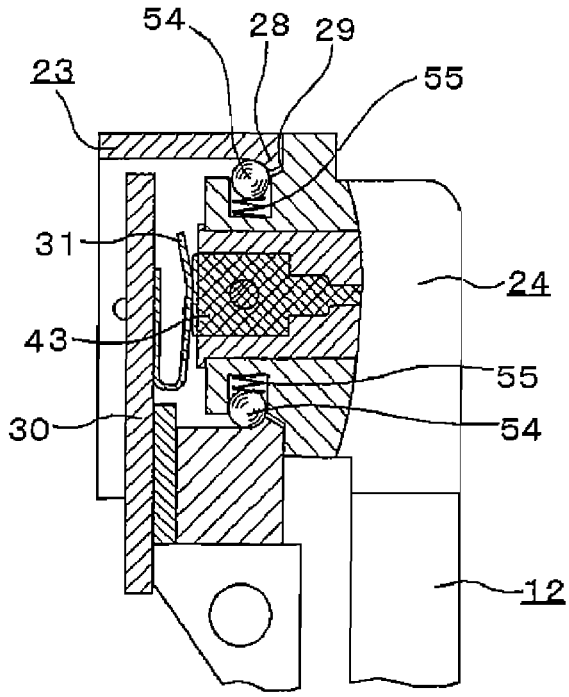
FIG. 5 is a partially cut-away front-view drawing of a third embodiment of an attachment/detachment mechanism for a compact antenna according to the present invention.
Figure 7:
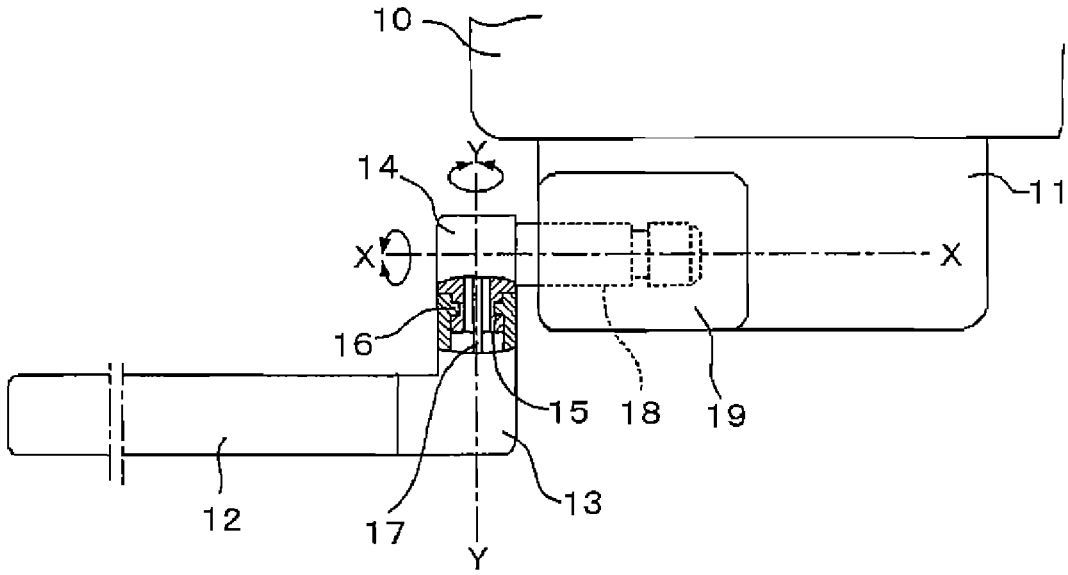
FIG. 7 is a partially cut-away front-view drawing of a conventional attachment/detachment mechanism for a compact antenna.
Figure 6:
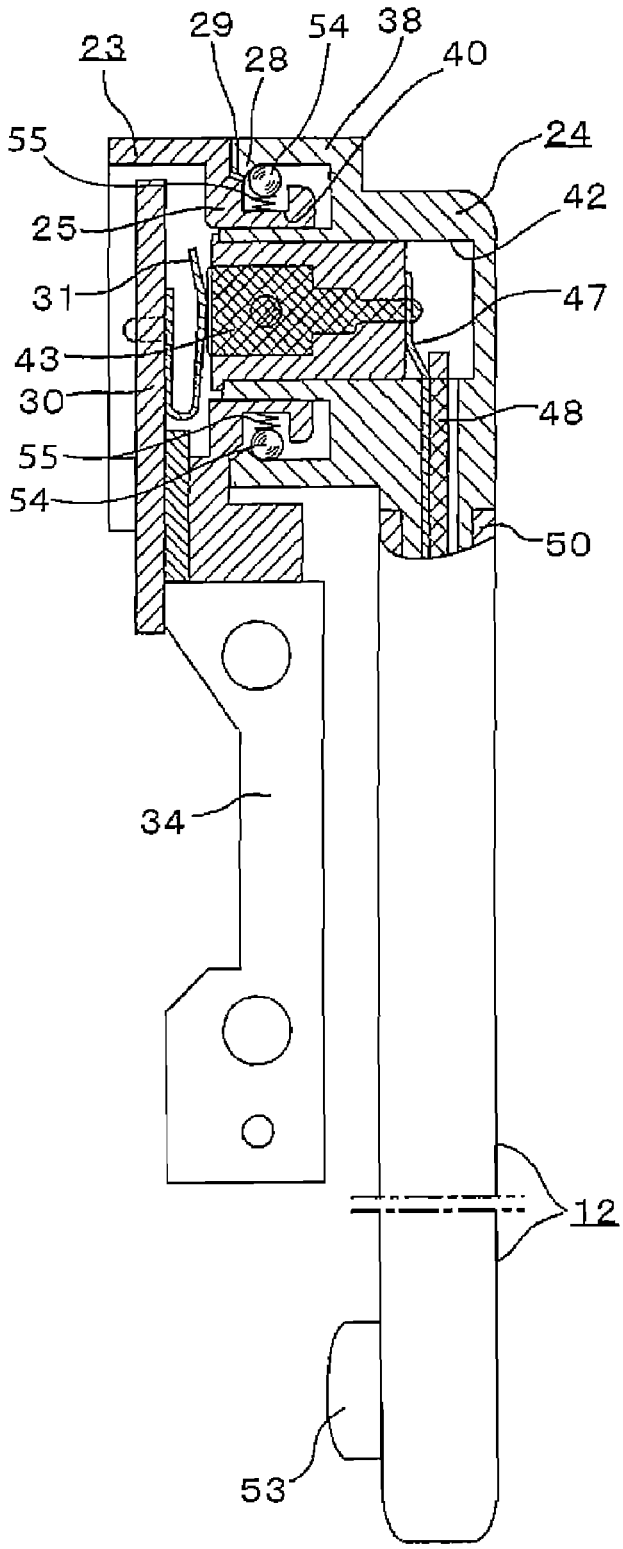
FIG. 6 is a partially cut-away front-view drawing of a fourth embodiment of an attachment/detachment mechanism for a compact antenna according to the present invention.

In the first embodiment and the second embodiment described above with reference to FIGS. 1-4, retention of the fitting cylinder 25, 38 on the antenna housing 23 is enabled by the O-ring 41. As shown in FIGS. 5 and 6, however, it would also be possible to provide multiple balls 54 in the fitting groove 40 biased outward by the spring 55. In this case, the side walls of the fitting groove 40 are curved slightly inward above the center of the balls 54 to prevent the balls 54 from slipping out from the fitting groove 40.

In the third embodiment shown in FIG. 5, multiple balls 54 and the spring 55 are provided in the fitting groove 40 of the L-shaped rotation connector 24 on the antenna 12 side, and the engagement projection 28 is provided on the fitting cylinder 25 on the antenna housing 23 side. In the fourth embodiment shown in FIG. 6, multiple balls 54 and the spring 55 are provided on the fitting cylinder 25 on the antenna housing 23 side and the engagement projection 28 is provided on the L-shaped rotation connector 24 on the antenna 12 side.

As shown in FIG. 3, in these embodiments, the antenna housing 23 is fitted and attached to the antenna attachment section 22 on the side end of the hinge 21 of the main electronic device unit 20. However, the present invention is not restricted to this, and it would also be possible to have the antenna housing 23 formed integrally ahead of time with the side end section of the hinge 21 of the main electronic device unit 20.

In the embodiment shown in FIG. 1, the antenna 12 is formed separately from the L-shaped rotation connector 24, and the guide 46 of the L-shaped rotation connector 24 fits with the cover 50 of the antenna 12. However, it would also be possible to have these elements formed integrally. In this case, it would be preferable for the cover 50 covering the antenna element 47 to be bendable as much as possible.

Numerous details have been set forth in this description, which is to be taken as a whole, to provide a more thorough understanding of the invention. In other instances, well-known features have not been described in detail, so as to not obscure unnecessarily the invention.

The invention includes combinations and subcombinations of the various elements, features, functions and/or properties disclosed herein. The following claims define certain combinations and subcombinations, which are regarded as novel and non-obvious. Additional claims for other combinations and subcombinations of features, functions, elements and/or properties may be presented in this or a related application.

What is claimed is:

1. An attachment/detachment mechanism for a compact antenna in which an antenna housing is provided on a main electronic device unit and an L-shaped rotation connector is connected to said antenna housing, wherein: a removable and rotatable connection between said antenna housing and said L-shaped rotation connector is provided by forming a fitting groove on an outer perimeter of a male fitting cylinder on said L-shaped rotation connector side, fitting an elastic O-ring in said fitting groove, and forming an engagement projection on an inner wall of a female fitting cylinder on said antenna housing side; and wherein a contact member having an exposed tip is attached to a fitting hole of said fitting cylinder; and a contact spring engages said contact member and a contact section inside said antenna housing, and pushes said O-ring toward said engagement projection.

2. An attachment/detachment mechanism for a compact antenna according to claim 1, wherein the L-shaped rotation connector is covered at one end with a cover that is formed integrally with a second engagement projection for engaging a side surface of the main electronic device unit.

3. An attachment/detachment mechanism for a compact antenna in which an antenna housing is provided on a main electronic device unit and an antenna is connected to said antenna housing, an L-shaped rotation connector provided on said antenna being rotatably and detachably connected to said antenna housing, wherein said rotatable and removable connection between said antenna housing and said L-shaped rotation connector is provided by forming a fitting groove on an outer perimeter of a male fitting cylinder on said L-shaped rotation connector side, fitting a plurality of balls biased outward by a spring in said fitting groove, and forming an engagement projection on an inner wall of a female fitting cylinder on said L-shaped rotation connector side to engage and push against said balls; a contact member having an exposed tip is attached to a fitting hole of the male fitting cylinder on said L-shaped rotation connector side; and a contact spring engages said contact member and a contact section inside said antenna housing, and pushes said O-ring toward said engagement projection.

4. An attachment/detachment mechanism for a compact antenna in which an antenna housing is provided on a main electronic device unit and an antenna is connected to said antenna housing, an L-shaped rotation connector provided on said antenna being rotatably and detachably connected to said antenna housing, wherein said rotatable and removable connection between said antenna housing and said L-shaped rotation connector is provided by forming a fitting groove on an outer perimeter of said male fitting cylinder on said antenna housing side, fitting a plurality of balls biased outward by a spring in said fitting groove, and forming an engagement projection on an inner wall of a female fitting cylinder on on said L-shaped rotation connector side to engage and push against said balls; a contact member having an exposed tip is attached to a fitting hole of the female fitting cylinder on said L-shaped rotation connector side; and a contact spring engages said contact member and a contact section inside said antenna housing, and pushes said O-ring toward said engagement projection.

5. An attachment/detachment mechanism for a compact antenna in which an antenna housing is provided on a main electronic device unit and an antenna is connected to said antenna housing, an L-shaped rotation connector provided on said antenna being rotatably and detachably connected to said antenna housing, wherein said rotatable and removable connection between said antenna housing and said L-shaped rotation connector is provided by forming a fitting groove on an outer perimeter of a male fitting cylinder on said antenna housing side, fitting an elastic O-ring into said fitting groove, and forming an engagement projection on an inner wall of a female fitting cylinder on said L-shaped rotation connector side to engage and push against said O-ring, and wherein a contact member having an exposed tip is attached to a fitting hole of the female fitting cylinder on said L-shaped rotation connector side; and a contact spring engages said contact member and a contact section inside said antenna housing, and pushes said O-ring toward said engagement projection.

* * * * *